United States Patent [19]

Brodmann

[11] 4,049,870

[45] Sept. 20, 1977

[54] BACKCOATING OF POLYPROPYLENE FABRIC

[75] Inventor: George Brodmann, Akron, Ohio

[73] Assignee: PPG Industries, Inc., Pittsburgh, Pa.

[21] Appl. No.: 643,424

[22] Filed: Dec. 22, 1975

[51] Int. Cl.[2] ..... B05D 3/02

[52] U.S. Cl. ..... 428/424; 260/33.8 UA; 260/33.8 UB; 260/859 PV; 417/385 B; 417/390 R; 428/425; 428/515; 428/516; 428/517; 428/518; 428/523

[58] Field of Search ..... 260/33.8 UB, 859 PV, 260/33.8 UA; 427/385 B, 390 R; 428/424, 425, 515, 516, 517, 518, 521, 523

[56] References Cited

U.S. PATENT DOCUMENTS

| | | | |
|---|---|---|---|
| 3,024,216 | 3/1962 | Smitmans et al. | 260/859 PV |
| 3,236,675 | 2/1966 | Hermitte et al. | 260/859 PV |
| 3,257,261 | 6/1966 | Hochberg | 260/33.8 UB |
| 3,809,603 | 5/1974 | Kooi et al. | 260/859 PV |

*Primary Examiner*—Michael R. Lusignan

[57] ABSTRACT

Backcoated polypropylene fabric is prepared by applying to one side of polypropylene fabric a backcoating composition of poly(vinyl chloride/vinylidene chloride) copolymer in 1,1,1-trichloroethane solvent and subsequently vaporizing the solvent from the fabric.

5 Claims, No Drawings

BACKCOATING OF POLYPROPYLENE FABRIC

BACKGROUND OF THE INVENTION

Polypropylene fabric has achieved commercial acceptance for decorative applications such as upholstery because of its soil resistance and other desirable properties. Backcoatings are commonly applied to aid the fabric in retaining its size, shape, and integrity in service. A "backcoat" is a polymer layer confined to one surface of the treated fabric.

Polypropylene fabrics are customarily backcoated with aqueous-based dispersions or emulsions of acrylic-type polymers. A disadvantage of aqueous-based systems is that polypropylene is temperature sensitive in comparison to other commercial fibers. Polypropylene fabric softens at about 150° C. and its highest recommended drying temperature is about 122° C. As a consequence of the limited degree of heat which may be applied to accelerate water vaporization, the drying of aqueous-base applied backcoating on polypropylene is a relatively slow procedure.

Polypropylene is known to deform or dissolve in chlorinated solvents, particularly when these solvents are employed at elevated temperatures.

FIELD OF THE INVENTION

This invention relates to backcoated polypropylene fabrics and their method of preparation.

THE INVENTION

This invention is an article of manufacture in the form of a polypropylene fabric backcoated with polymer containing a major portion of poly(vinyl chloride/-vinylidene chloride) copolymer. In addition, this invention is a method of preparing backcoated polypropylene by applying to one surface of the polypropylene fabric a composition containing poly(vinyl chloride/vinylidene chloride) copolymer in 1,1,1-trichloroethane containing solvent and subsequently vaporizing the solvent at the above ambient temperatures to affix the polymer onto one surface of the fabric.

This invention permits the rapid backcoating of polypropylene fabric. In addition, this invention permits a strong backcoating to be applied with a lesser amount of backcoat polymer than is required for aqueous-based backcoating systems.

DETAILED DESCRIPTION OF THE INVENTION

The Polypropylene Fabric

The polypropylene used in this invention is preferably crystalline (e.g., polypropylene having an isotacticity index over 90) with the attendant properties of higher tensile strength and low solvent penetration. Typically, the melting point of the isotactic polypropylene fibers is in the range of 160° to 170° C.

The polypropylene "fabric" may be any material formed of yarns, filaments or fibers in any manner to give a substrate capable of receiving a backcoat. In most instances, the fabric is a woven structure. The product and process of this invention may be advantageously applied to both closed and open weaves polypropylene fabrics.

The Backcoating Composition

The "backcoating composition" refers to the liquid formulation containing as essential ingredients (1) polymer, and (2) solvent, which is applied to one surface of the polypropylene fabric to form the backcoat layer.

The "solvent" ingredient of the backcoating composition is substantially 1,1,1-trichloroethane. The use of 1,1,1-trichloroethane is an important aspect of this invention because it possesses a combination of properties important to performance of the process of this invention. In particular, 1,1,1-trichloroethane has the properties of high volatility below the softening point of polypropylene, ability to dissolve a variety of organic polymers, and the ability to contact polypropylene at elevated temperatures (above 50° C.) without causing a swelling or solution. It is preferred that 1,1,1-trichloroethane constitute substantially all of the solvent; however, small amounts usually less than 10 weight percent of other organic compounds in commercially available 1,1,1-trichloroethane such as stabilizers therefor may be present. Examples of such types of stabilizer compounds are acetylenic alcohols, dioxane, nitromethane, lower alkyl epoxides, and tertiary amines.

The "polymer" ingredient of the backcoating composition is poly(vinyl chloride/vinylindine chloride) copolymer used alone or in admixture with polyurethane polymer. It is an aspect of this invention that the polymer of the backcoat contain at least 50 weight percent of a solid, high molecular weight; 1,1,1-trichloroethane soluble poly(vinyl chloride/vinylidine chloride) copolymer. More desirably, the poly(vinyl chloride/-vinylidene chloride) copolymer content represents from 65 to 85 weight percent of the polymer ingredient. It is especially preferred that a bipolymer of vinyl chloride and vinylidene chloride be used as the polymer ingredient, however, poly(vinyl chloride/ vinylidine chloride) copolymers containing a small proportion (up to 10 mole percent) of other copolymerized monomers (e.g., vinyl acetate, ethyl acrylate, acrylonitrile) are acceptable. The described poly(vinyl chloride/vinylidene chloride) copolymers have the property of high solubility is chlorinated organic solvents. This high solubility (over 10 percent by weight) in 1,1,1-trichloroethane allows the direct preparation of viscous polymer solution necessary for the preferred operation of this invention. In addition, these polymers are generally of low cost and wide availability. Suitable poly(vinyl chloride/ vinylidene chloride) copolymers are prepared by free-radical polymerization of vinyl chloride and vinylidene chloride. Good solubility in 1,1,1-trichloroethane is associated with little or no crystallinity in the polymer. The desirable solubility characteristic is achieved by copolymerization of vinyl chloride and vinylidene chloride to provide copolymers having substantial molar proportions of each constituent, for example, poly(vinylidene chloride) bipolymers with 20 to 80 mole percent, and preferably 40 to 60 mole percent vinylidene chloride.

The physical properties of the poly(vinyl chloride/-vinylidene chloride) copolymer are improved (made more flexible and soft) by inclusion of a solid, high molecular weight, 1,1,1-trichloroethane soluble polyurethane polymer. A suitable proportion of urethane polymer is between 10 and 40 weight percent. The necessary physical properties of the urethane polymer are that it be moderately soluble in 1,1,1-trichoroethane (at least 5 weight percent) and capable of forming a solid, non-tacky coating. Suitable urethane polymers are those formed by the reaction of organic diisocyanates (such as toluene diisocyanate or cyclohexyl diisocyanate) with high molecular weight (viz., 700 – 20,000) organic polyols (such as polyester polyol or polyether polyol) and optionally a low molecular weight polyol chain extender (such as 1,4-butanediols). Either aliphatic or aromatic polyisocyanates are suitable, but aromatic types are preferred because of lower cost.

An especially preferred backcoating of this invention is 80 parts by weight of poly(vinyl chloride/vinylidene chloride) bipolymer and 20 parts by weight of aromatic polyurethane.

The polymer concentration in the backcoating composition must be adjusted so that the solution has a viscosity such that the composition when contacted with one surface of the polypropylene fabric will not migrate to the opposite surface and adversely affect the appearance of the fabric. Generally, a backcoating composition viscosity from between 1,500 to 15,000 centipoises is desired with viscosities from 2,400 to 8,000 centipoises being preferred. The backcoating compositions of this invention are nonaqueous organic solvent and organic polymer containing formulations. The viscosity of the backcoating composition may be monitored and adjusted by addition of solvent or polymer as deemed necessary. The adjustment of viscosity may be accomplished solely by dissolving sufficient polymer in 1,1,1-trichlorethane until the desired viscosity properties are obtained. Alternately, the viscosity may be achieved by the use of known thickening agents such as silicas, carboxymethylcellulose or solvent soluble starches. It is the preferred practice of this invention to achieve the desired viscosity in the backcoating composition primarily by solution of sufficient polymer in the solvent, since viscosity increasing agents and fillers often descrease bond strength or increase flammability.

Application of the Backcoat Layer

Application of the backcoating composition to one surface of the polypropylene fabric may be done by any conventional technique such as spraying, spreading, draw knife, or transfer roll casting. It is preferred to employ methods which minimize vaporization of the 1,1,1-trichloroethane solvent until its removal is desired. In practice, a transfer roll coating method wherein a roller dips into backcoating composition and carries the compositon to the underside of a piece of polypropylene fabric horizontally disposed over the transfer roll lends itself to ease of operation with good uniformity. The transfer roll technique used with the backcoating compositions of this invention can conveniently deposit between 25 to 300 weight percent based on the weight of a fabric of backcoat composition.

The weight of backcoat to be applied to the polypropylene will be dependent on the weight of the fabric and the "hand" desired in the final coated polypropylene fabric. Woven polypropylene fabrics used for upholstery typically have weights between 4 to 10 oz. per square yard (135 to 339 grams/meter). A polymer backcoat (absent solvent) constituting between 10 and 150 weight percent based on the weight of the fabric is generally desirable for such upholstery weight fabrics.

The backcoat composition may be applied to the polpypropylene fabric in a series of steps. The polymer is affixed to the fabric by volatilizing the solvent from the applied backcoat composition. A plurality of applications of backcoat composition may be applied with volatilization of all or part of the 1,1,1-trichlorethane solvent following each application. The final volatilization step should remove substantially all the solvent from the fabric.

Volatilization of the 1,1,1-trichloroethane is preferably conducted with the aid of heat to permit rapid processing. Heat may be transferred to the solvent containing backcoat by any means such as conduction, convection, or radiation. It is preferred to volatilize solvent by convective means such as passing heated air about the treated fabric. Air temperatures of about 30° to 120° C. may be used to advantage. The vaporized 1,1,1-trichloroethane may be extracted from the drying media by known techniques such as condensation coils or carbon adsorption beds. The recovered solvent may then be returned to the process for formulation of additional backcoating composition as part of a continuous backcoating process.

The following Example serves to illustrate the invention:

EXAMPLE

The backcoating apparatus used in all of the following experiments consisted of an assembly containing an 18 inch (45.7 cm.) wide, 3 inch (7.62 cm.) diameter roller held by two horizontal supports in a manner such that the bottom one-half of the roll dipped into a tray containing backcoating composition. The roll was driven about its horizontal axis so that a film of backcoating composition was continuously present on its circumference. An apron guided polypropylene fabric of fourteen inch (35.6 cm.) width horizontally and tangential to the top of the transfer coating roll so that a portion of the composition adhering to the circumference of the roll was transferred to the fabric. Thereafter, the backcoat was dried by sending the fabric through a bank of infra-red lamps. The fabric was wound onto a collecting roll after drying.

Strength of the backcoat was elevated with the Pin-slip test. A pin claw formed of a metal plate containing five thin upwardly disposed pins spaced 0.150 inches (3.81 mm.) apart if forced into the back of a 2 × 3 inches (50.8 mm. × 76.2 mm.) fabric sample. The pin claw is clamped into the upper jaw of an Instron tensile tester, while the fabric is clamped into the lower jaw. The jaws of the tester are separated at a rate of 2 inches (50.8 mm.) per minutes. Resistance to slippage is measured as the pounds pull (across a seam) per inch of width necessary to produce an elongation of one fourth inch (6.35 mm.) in excess of the normal stretch of the fabric under the same load (see, ASTM D-434-42).

Part A

Polypropylene fabric samples 1, 2, 3 and 4 were prepared as control experiment to stimulate prior art backcoating methodology using aqueous-based systems. The backcoating apparatus described in the preceding part of the Example was used in performing the tests.

Samples 1, 2, 3 and 4 were backcoated with an ethyl acrylate polymer (designated as "Acrylic/Aqueous" in the Table). The "Acrylic/Aqueous" backcoating composition contained 400 parts by weight of 40 weight percent poly(methyl methacrylate/acrylic acid) copolymer water emulsion in 2,400 parts of water. The detailed preparation of this emulsion is described in the *Journal of American Textile Chemists and Colorists*, January 1973, Vol. 5, No. 1, pages 21 to 24, which description is incorporated herein by reference.

Part B

Polypropylene fabric samples 5, 6, 7 and 8 were prepared in accordance with the practice of this invention using the backcoating apparatus described in the initial part of this example.

Samples 5, 6, 7 and 8 were backcoated with the following composition (designated "Polymer/1,1,1-Trichloroethane" in the Table):

| | | |
|---|---|---|
| poly(vinyl chloride/vinylidene chloride) copolymer (Geon 222, product of B. F. Goodrich Co.) | 50.5 | grams |
| aromatic polyurethane resin (Estane 5711, product of B. F. Goodrich Co.) | 10 | grams |
| alumina filler (Reynolds Alumina RH-31 F, product of Reynolds Aluminum Co.) | 25 | grams |
| 1,1,1-trichloroethane | 254.5 | grams |

Test results are displayed in the Table.

The experimental results indicate that the backcoating composition of this invention is capable of producing acceptable pin-slip values at lower polymer add-on levels than a strandard aqueous system.

Sample 9 gives a comparative pin-slip value for untreated polypropylene fabric.

TABLE

| SAMPLE NO. | RESIN/MEDIA | BACKCOATED POLYPROPYLENE FABRIC[1] RESIN/MEDIA VISCOSITY (CPS) | METHOD OF APPLICATION | ADD-ON OZ./YD.$^2$ (GMS./M)$^2$ | PIN SLIP TEST LBS. (KG.) | FABRIC[5] HANDLE |
|---|---|---|---|---|---|---|
| 1 | Acrylic/Aqueous[4] | 10,600 | Transfer Roller Coating | 3.5 (119) | 11.3 (5.12) | Soft |
| 2 | Acrylic/Aqueous[4] | 10,600 | Transfer Roller Coating | 5.8 (197) | 20.7 (9.38) | Soft |
| 3 | Acrylic/Aqueous[4] | 10,600 | Transfer Roller Coating | 7.8 (264) | 27.1 (12.28) | Full-Soft |
| 4 | Acrylic/Aqueous[4] | 10,600 | Transfer Roller Coating | 8.6 (292) | 43.2 (19.57) | Very full; Slightly Stiff |
| 5 | Polymer/1,1,1-Trichloroethane[3] | 2,950[2] | Transfer Roller Coating | 1.2 (41) | 5.6 (2.54) | Flimsy |
| 6 | Polymer/1,1,1-Trichloroethane[3] | 2,950[2] | Transfer Roller Coating | 1.8 (61) | 9.8 (4.44) | Slightly Flimsy |
| 7 | Polymer/1,1,1-Trichloroethane[3] | 2,950[2] | Transfer Roller Coating | 3.3 (112) | 17.2 (7.79) | Soft |
| 8 | Polymer/1,1,1-Trichloroethane[3] | 2,950[2] | Transfer Roller Coating | 5.3 (180) | 24.8 (11.23) | Very full; Slightly Stiff |
| 9 | Untreated | — | — | 0 | 2.1 (0.95) | Wash, Limp |

[1]Polypropylene fabric; flat, tightly woven. Uncoated weight - 7½ oz. yd.$^2$ (255 gms./m).
[2]Thickened to 3,150 cps after several hours storage.
[3]80 parts by weight of poly(vinyl chloride/vinylidene chloride) bipolymer and 20 parts by weight thermoplastic aromatic polyurethane.
[4]Ethyl acrylate polymer prepared with an anionic emulsifier.
[5]Subjective determination of fabric qualities such as stiffness, harshness, tackiness, etc.

Although the present invention has been described with reference to the specific details of particular embodiments thereof, it is not intended to limit the scope of the invention except insofar as the specific details are recited in the appended claims.

I claim:

1. A method of backcoating polypropylene fabric by applying to one surface of the fabric a coating composition comprising polymer and solvent, said polymer being a solid high molecular weight 1,1,1-trichloroethane soluble polymer containing at least 50 weight percent of poly(vinyl chloride/vinylidene chloride) copolymer and said solvent consisting essentially of 1,1,1-trichloroethane; thereafter, affixing the polymer by volatilizing the solvent from the fabric.

2. A method according to claim 1 wherein the solvent is volatilized at a temperature above 50° C.

3. A method according to claim 1 wherein the polymer consists essentially of 65 to 85 weight percent based on the total weight of polymer of a poly(vinyl chloride/vinylidene chloride) bipolymer having 20 to 80 mole percent vinylidene chloride, said bipolymer being admixed with 10 to 40 percent of polyurethane polymer.

4. The method of claim 1 wherein the sequence of applying backcoating composition and volatilizing solvent is repeated until 10 to 150 weight percent of polymer based on the weight of fabric is applied.

5. A polypropylene fabric coated on one surface with between 10 to 150 percent by weight of fabric of a solid high molecular weight 1,1,1-trichloroethane soluble polymer, said fabric prepared in accordance with the method of claim 3.

* * * * *

UNITED STATES PATENT AND TRADEMARK OFFICE

CERTIFICATE OF CORRECTION

PATENT NO. : 4,049,870

DATED : September 20, 1977

INVENTOR(S) : George Brodmann

It is certified that error appears in the above-identified patent and that said Letters Patent are hereby corrected as shown below:

Column 6, line 5, insert --back-- before "coating".

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*